US005677926A

United States Patent [19]

Blum et al.

[11] Patent Number: 5,677,926

[45] Date of Patent: Oct. 14, 1997

[54] CRUCIBLE FOR THE INDUCTIVE MELTING OF METALS

[75] Inventors: Matthias Blum, Büdingen; Wilfried Goy, Kelsterbach; Franz Hugo, Aschaffenburg; Karlheinz Hock, Elsenfeld, all of Germany

[73] Assignee: ALD Vacuum Technologies GmbH, Erlensee, Germany

[21] Appl. No.: 729,587

[22] Filed: Oct. 11, 1996

[30] Foreign Application Priority Data

Jun. 7, 1996 [DE] Germany ..... 196 22 884.0

[51] Int. Cl.[6] ..... H05B 6/22

[52] U.S. Cl. ..... 373/156; 373/151; 75/10.16

[58] Field of Search ..... 373/151, 155, 373/156, 158; 75/10.16, 10.18, 10.14

[56] References Cited

U.S. PATENT DOCUMENTS

| | | | |
|---|---|---|---|
| 3,223,519 | 12/1965 | Schippereit | 373/155 |
| 3,461,215 | 8/1969 | Reboux | 373/156 |
| 4,738,713 | 4/1988 | Stickle et al. | 75/10.18 |
| 5,109,389 | 4/1992 | Stenzel | 373/156 |
| 5,283,805 | 2/1994 | Kawano et al. | 373/156 |

FOREIGN PATENT DOCUMENTS

| | | |
|---|---|---|
| 518499 | 3/1931 | Germany . |
| 4209964 | 11/1993 | Germany . |
| 4429340 | 7/1996 | Germany . |
| 1067325 | 1/1964 | United Kingdom . |
| 1067324 | 2/1964 | United Kingdom . |
| 1067326 | 2/1964 | United Kingdom . |
| 1067323 | 8/1964 | United Kingdom . |

*Primary Examiner*—Tu B. Hoang
*Attorney, Agent, or Firm*—Felfe & Lynch

[57] ABSTRACT

Vertical, parallel palisades (3) are distributed around the perimeter of a circle, spaced apart by gaps, surrounding the melt. An annular plate (4) supports the palisades (3), the palisades being provided with cavities through which a coolant flows. An induction coil (20) surrounds the palisades (3) on the outside, an alternating current flowing through the coil. The plate (4) is provided with support surfaces (4*a*, 4*b*), equal in number to the number of palisades (3), their shape conforming to the base surfaces of the palisades (3). Seen in the circumferential direction, every second support surface (4*a*) is covered by an electrically insulating film (7). All of the palisades (3) together are surrounded by a ring (18) of electrically insulating material, which holds the palisades (3) on the plate (4).

10 Claims, 2 Drawing Sheets

CRUCIBLE FOR THE INDUCTIVE MELTING OF METALS

BACKGROUND OF THE INVENTION

The invention pertains to a crucible for the inductive melting or super-heating of metals, alloys, or other electrically conductive materials with a plurality of palisades, arranged in vertical fashion, parallel to each other, distributed around a circle a certain distance apart and supported by a disk-shaped part forming the bottom of the crucible. At least parts of the palisades are provided with cavities, through which a coolant flows. An induction coil surrounds the palisades a certain distance away from the palisades, the coil being supplied with an alternating current.

A process for melting difficult-to-melt metals, especially tantalum, tungsten, thorium, and the alloys of these metals, in a water-cooled container (DE 518 499) is known. In this case the container is made of a material, e.g., quartz glass, copper, or silver, with a melting point which is lower than that of the material to be melted. The energy required for melting the metal and for cooling the container is provided in such a way that all of the material is melted without contamination by the material of the crucible. The crucible itself is heated by an induction coil; the current is prevented from coursing around the crucible by constructing the crucible of individual segments, which are separated from each other by an insulating layer of, for example, mica.

U.S. Pat. No. 3,461,215 discloses high-frequency induction crucible which is formed of a plurality of palisades, all of the palisades being arranged vertically on a circular, disk-shaped bottom plate to form a hollow cylinder. Cooling water flows through all of the current-conducting and heat-conducting palisades, which are also surrounded by an induction coil. The bottom plate of ceramic material is provided with a cover, through which the melt can be removed. Strips of insulating material are inserted between the palisades.

U.S. Pat. No. 4,738,713 discloses a crucible for the slagless melting of highly pure reactive metals in a vacuum chamber. In this case, cooling water flows through the palisades, which are surrounded by the induction coil. The. palisades are screwed to a circular, disk-shaped bottom plate. The tubular palisades are separated from each other by slots, and they are also connected to each other electrically by way of the bottom plate, which is made of metal.

The known crucibles suffer from the disadvantage that they have a comparatively poor degree of thermal efficiency. The attempt has therefore been made to add insulating material to the melt to reduce the heat loss caused by the cooled palisades, but this led in turn to a contamination, however small, of the melt (Schippereit, et al.). This contamination of the melt material, however, is undesirable in many modern applications, so that this process has not been adopted by industry on a widespread basis.

The arrangement and design of the palisades themselves, their electrical connection to each other, and their insulation from each other have also been the object of many investigations. U.S. Pat. No. 3,223,519, for example, describes crucible segments which are insulated from each other, whereas in the case of the crucible according to U.S. Pat. No. 4,738,713 the palisades are set up a certain distance away from each other and are connected electrically to each other.

SUMMARY OF THE INVENTION

The object of the present invention is to provide a crucible which operates without the need for insulating slag material and with a reduced level of energy losses.

In accordance with the invention the bottom plate of the crucible is provided with support surfaces conforming to the bottom ends of the palisades, the number of these surfaces being equal to the number of palisades. Seen in the circumferential direction, every second support surface is covered by an electrically insulating film, and the plate has a pair of holes in each support surface, these holes corresponding to cavities in the palisades. One of the two holes of each pair in the plate is connected to a coolant chamber, while the other holes is connected to a dome-like member forming the bottom of the crucible. The palisades are surrounded as a whole by a ring of electrically insulating material, which holds the palisades on the plate.

DETAILED DESCRIPTION OF THE PREFERRED EMBODIMENT

Figure 1:
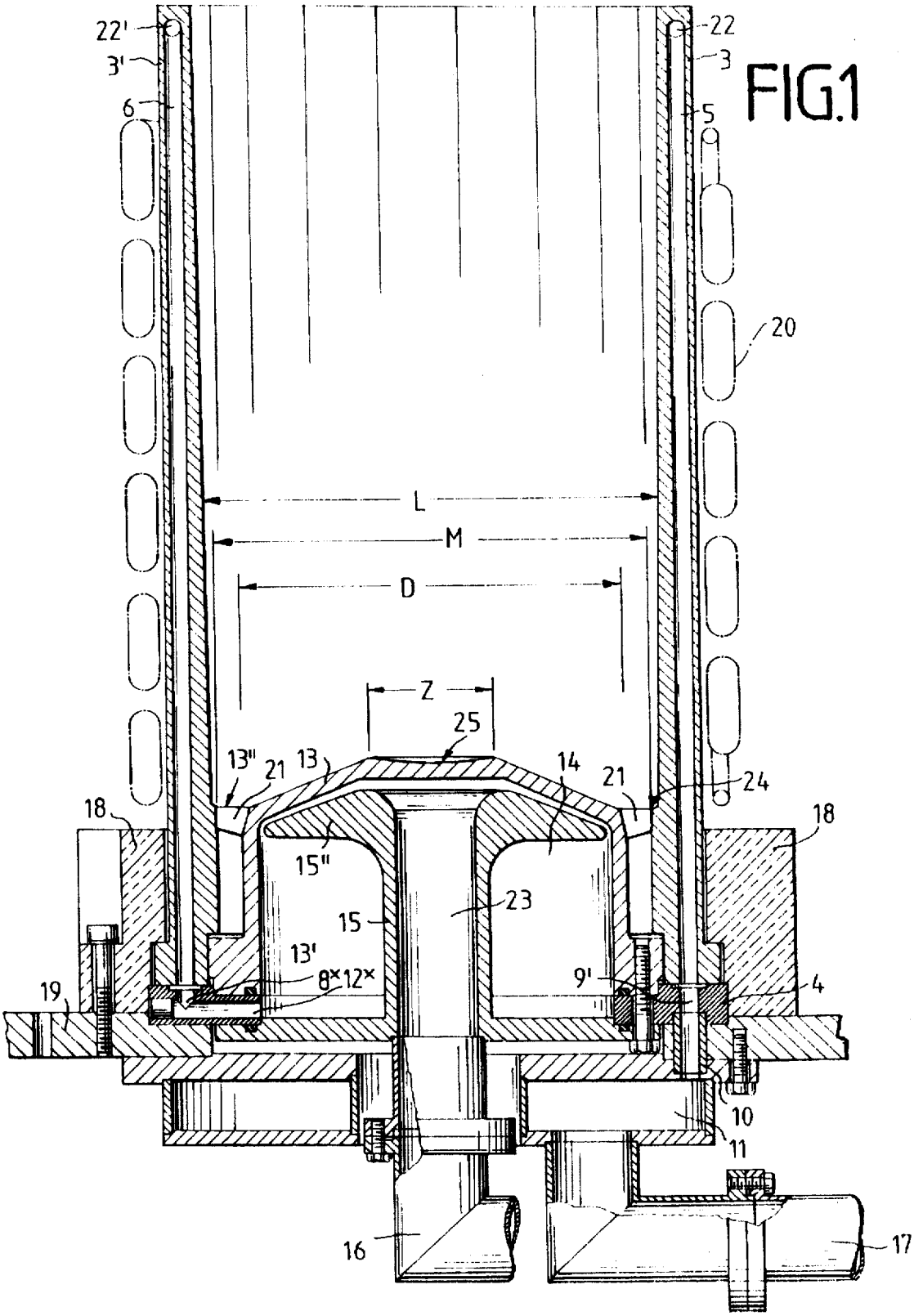
FIG. 1 is an axial cross section through the crucible according to the invention.
Figure 2:
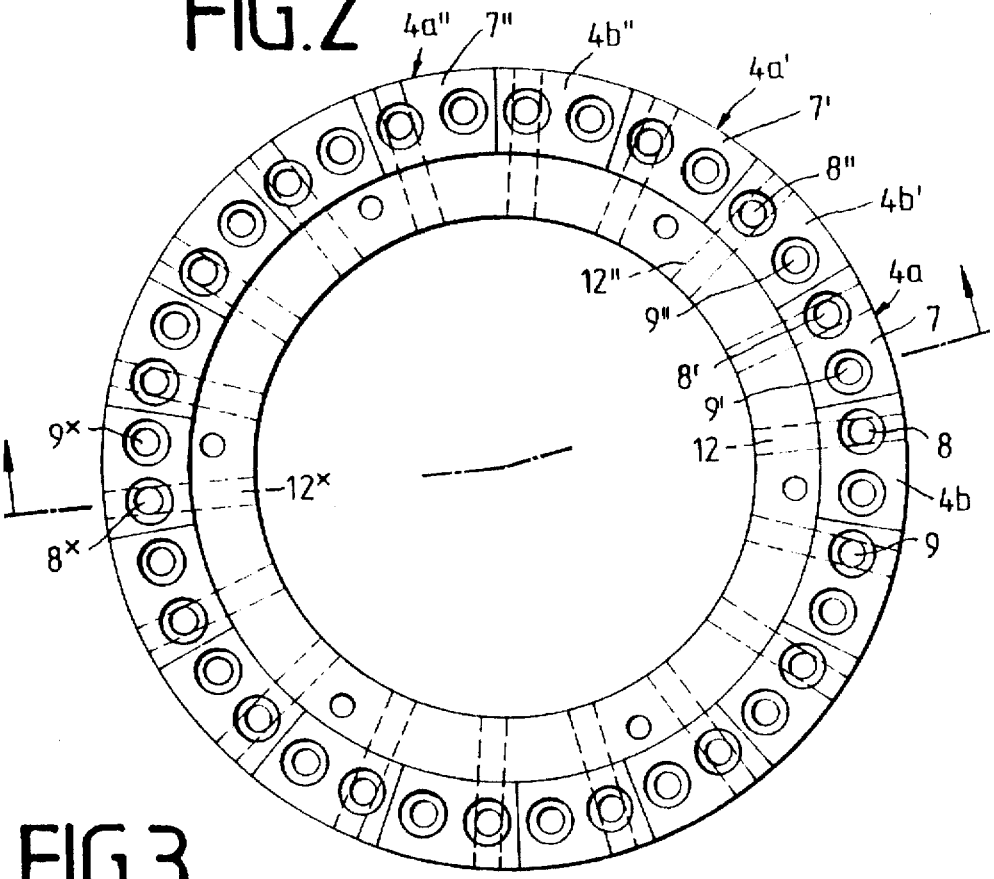
FIG. 2 is a plan view of the plate which supports the palisades.
Figure 3:
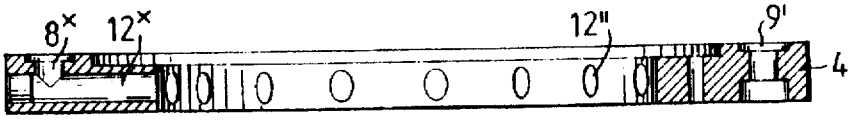
FIG. 3 is a cross section through the plate along line 3—3 of FIG. 2.
Figure 5:
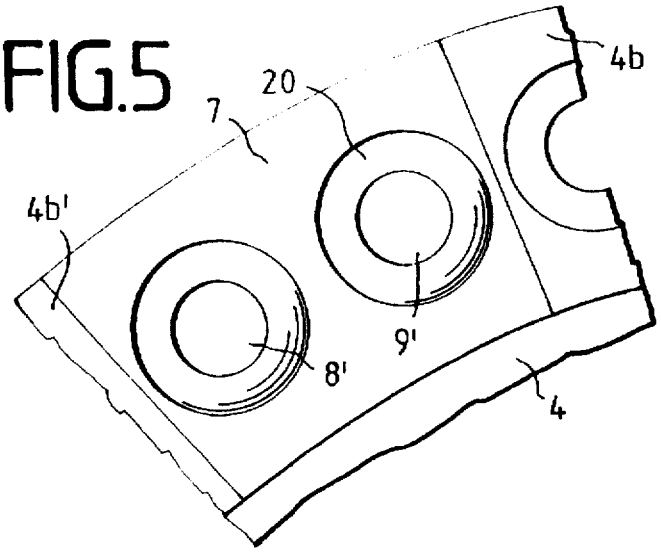
FIG. 5 is an enlarged partial radial section view through the plate.
Figure 4:
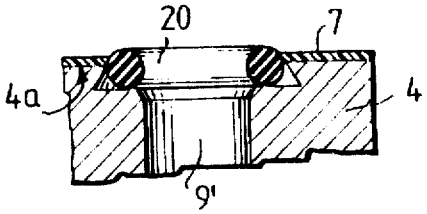
FIG. 4 is an enlarged partial plan view showing s support surface of the plate.

The crucible includes a plurality of individual palisades 3, all of the same design and made of electrically conductive material, all of which stand vertically on a horizontally oriented bottom plate 4, which also consists of conductive material. Each palisade is provided with two longitudinal bores 5. The palisades are separated by gaps, so that there is no electrical contact between them along their vertical sides. The bottom ends or base surfaces of palisades 3, rest on an annular support plate 4, the top of which (as FIG. 2 shows) is divided into a number of support surfaces **4*a*, 4*b*, in the form of segments of a circular ring, the number of these surfaces being equal to the number of palisades (in the embodiment shown, a total of 18 support surfaces 4*a*, 4*b* are provided). In the circumferential direction, every support surface 4*a* is recessed to a slightly deeper extent into the bottom plate than the immediately adjacent support surface 4*b*. On the more deeply recessed first support surfaces 4*a*, pieces of film 7, of electrically insulating material are laid, so that the tops of films 7 on surfaces 4*a* are on the same plane as the tops of adjacent support surfaces 4*b*. Each of the support surfaces 4*a*, 4*b* has two vertical bores 8, 9. One bore 8 leads by way of a bore 12 extending radially through bottom plate 4 to an annular first chamber 14, which is formed by a dome-like member 13 of the bottom of the crucible and a mushroom-shaped section of coolant line 15. This chamber 14 is connected in turn by way of a central channel 23 to coolant line 16. The other bore 9 is connected by a bushing 10 to a second coolant chamber 11. This chamber 11 is connected to a coolant line 17. All palisades 3 are surrounded by an insulating ring 18, which is screwed to a crucible mounting plane 19. This ring holds the palisades in their vertical position and presses then firmly against support plate 4. To ensure that bores 5, 6 in palisades 3 have a leak-proof and pressure-tight connection to bores 8, 9 sealing rings 20 are laid between the bottom ends of the individual palisades 3 and support piece 4. Bottom piece 13 of the crucible is a dome-like member and is provided with a flange 13', which is screwed firmly to bottom plate 4 and to bottom part 15' of coolant guide piece 15**.

To ensure sufficient energy input from induction coil 20 surrounding palisades 3 into the melt, especially in the lower part of the melt, dome-like member 13 of the crucible has a circumferential edge 13", which extends to the inside surfaces of palisades 3 and is provided with a plurality of radial slots 21 uniformly distributed around the circumference of edge 13", the number of these slots being equal to the number of palisades (18 units). The slots are oriented vertically and are aligned with the gaps which palisades 3 form with each other. It should also be mentioned that the sides of the palisades which face each other, that is, the sides between which the slots are formed, are covered with electrically insulating layers, e.g., of aluminum oxide ($Al_2O_3$). In a similar manner, the corresponding slots 21 on circumferential edge 13" are also coated with an electrically insulating material. Bores 5, 6 in the individual palisades are connected at the their top ends to each other in pairs by transverse bores 22, so that the coolant flowing upward through one bore can flow back down through the parallel, adjacent bore in the same palisade 3. To prevent the possibility of electrical contact between the inside surfaces of palisades 3 and dome-like member 13 of the crucible in the area of collar 13", an electrically insulating film 24 is inserted between the palisades and collar 13". The outside surface of the palisades is also surrounded by a plastic film or a fabric of dielectric fibers.

We claim:

1. Crucible for induction melting of metals, said crucible comprising a plurality of vertically oriented palisades arranged in parallel around a circle and spaced apart by gaps, each palisade having a first cavity and a second cavity between which a coolant can flow, a support plate having a circular circumference and a plurality of upward facing first and second support surfaces alternating about said circumference, each support surface supporting a respective palisade, said first support surfaces being provided with an insulating film between said support plate and the palisades supported thereon, said second support surfaces being in direct contact with the palisades supported thereon, said plate having a plurality of pairs of bores therethrough, each pair comprising a first bore and a second bore, each said first bore communicating between a first coolant chamber and a respective said first cavity, each said second bore communicating between a second coolant chamber and a respective said second cavity, a ring of electrically insulating material surrounding said palisades and fixing said palisades to said plate, and an induction coil surrounding said palisades above said ring of electrically insulating material.

2. Crucible as in claim 1 further comprising a dome-like member located centrally of said palisades, said first chamber being formed by said dome-like member.

3. Crucible as in claim 2 wherein said dome-like member has a closed top end with an upward facing surface comprising a concave central recess surrounded by a frustoidal surface which slopes downward toward said palisades.

4. Crucible as in claim 2 comprising a coolant guide piece located inside said dome-like member, said guide piece comprising a disk-like base fixed to said support plate, said support plate having an annular shape, said guide piece further comprising an umbrella-like top part inside said dome-like member, and a central coolant channel extending between said base and said top part.

5. Crucible as in claim 2 wherein said dome-like member has an open bottom surrounded by a circumferential flange fixed to said support plate, said member further comprising a closed top end surrounded by a circumferential collar interrupted by radial slots which are in radial alignment with said gaps.

6. Crucible as in claim 5 wherein said dome-like member further comprises a cylindrical wall extending between said circumferential collar and said circumferential flange, said cylindrical wall being coaxial to said palisades arranged in a circle.

7. Crucible as in claim 5 wherein said induction coil extends downward at least as far as a plane formed by said circumferential collar.

8. Apparatus as in claim 5 wherein said radial slots are filled with electrically insulating material.

9. Apparatus as in claim 1 wherein said gaps are filled with electrically insulating material.

10. Apparatus as in claim 1 wherein said support surfaces have a circumferential width which is greater than a circumferential width of the corresponding palisades.

* * * * *

UNITED STATES PATENT AND TRADEMARK OFFICE

CERTIFICATE OF CORRECTION

PATENT NO. : 5,677,926
DATED : October 14, 1997
INVENTOR(S) : Blum et al.

It is certified that error appears in the above-identified patent and that said Letters Patent is hereby corrected as shown below:

On the cover, in the section titled References Cited - Foreign Patent Documents, add the following citation: --4307317 1994 Germany--.

In column 2, line 48, after "adjacent" add --second--.

Signed and Sealed this

Seventh Day of September, 1999

*Attest:*

Q. TODD DICKINSON

*Attesting Officer*

*Acting Commissioner of Patents and Trademarks*